US009481030B2

(12) United States Patent
Roberts

(10) Patent No.: US 9,481,030 B2
(45) Date of Patent: Nov. 1, 2016

(54) FOUNDRY CLOTH FILTER SETTER FOR VERTICAL MOLD MACHINES

(71) Applicant: Michael Roberts, Elkhorn, WI (US)

(72) Inventor: Michael Roberts, Elkhorn, WI (US)

( * ) Notice: Subject to any disclaimer, the term of this patent is extended or adjusted under 35 U.S.C. 154(b) by 168 days.

(21) Appl. No.: 14/610,967

(22) Filed: Jan. 30, 2015

(65) Prior Publication Data

US 2016/0221071 A1 Aug. 4, 2016

(51) Int. Cl.

| | |
|---|---|
| ***B22C 9/08*** | (2006.01) |
| ***B22C 19/00*** | (2006.01) |
| ***B22C 23/00*** | (2006.01) |

(52) U.S. Cl.

CPC ..... *B22C 9/086* (2013.01); *B22C 19/00* (2013.01); *B22C 23/00* (2013.01)

(58) Field of Classification Search

CPC ..... B22C 9/086; B22C 19/00; B22C 23/00; C21B 7/12; B01D 29/096; B01D 29/0018

USPC ..... 164/134, 358; 210/350–352

See application file for complete search history.

(56) References Cited

U.S. PATENT DOCUMENTS

| | | | | |
|---|---|---|---|---|
| 3,899,426 | A * | 8/1975 | Hirs | B01D 29/096 210/387 |
| 3,940,335 | A * | 2/1976 | Kalman | B01D 29/096 210/179 |
| 5,556,592 | A | 9/1996 | Hitchings | |
| 5,676,731 | A | 10/1997 | Hitchings | |
| 6,149,807 | A | 11/2000 | Previero | |
| 6,224,818 | B1 | 5/2001 | Hitchings et al. | |
| 8,656,982 | B2 | 2/2014 | Takashina et al. | |
| 2004/0238152 | A1 | 12/2004 | Campomanes et al. | |

* cited by examiner

*Primary Examiner* — Kevin E Yoon

(74) *Attorney, Agent, or Firm* — Absolute Technology Law Group, LLC

(57) ABSTRACT

A filter setter apparatus includes a housing to which an upper jaw and a lower jaw removably connect. The upper jaw has the shape of a rectangular bar with a plurality of upper jaw overlaps depending from either side of the upper jaw. The upper jaw has a mass causing a gravitational force acting on the upper jaw to clamp a filter inserted between the upper jaw and the lower jaw. The upper jaw partially encloses the lower jaw between the plurality of upper jaw overlaps. A filter setter system incorporates the above housing with a plurality of the above upper jaws and a plurality of the above lower jaws.

20 Claims, 5 Drawing Sheets

FOUNDRY CLOTH FILTER SETTER FOR VERTICAL MOLD MACHINES

BACKGROUND

1. Field of Invention

This invention relates to the field of metal founding, and more specifically to an apertured strainer means for separating unwanted components from casting material.

2. Description of Related Art

Sand casting, also known as sand molded casting, is a metal casting process characterized by using sand as the mold material. The term "sand casting" can also refer to an object produced via the sand casting process. Specialized factories called foundries produce sand castings. Production of over 70% of all metal parts occurs via a sand casting process such as the DISAMATIC process.

High-volume foundries typically use vertical molding processes such as the DISAMATIC process. Molds form a line allowing pouring of castings one after another. The process blows a molding sand mixture into a molding chamber using compressed air. The process then squeezes the molding sand between patterned plates, each of which ultimately forms half of the pattern of the sand mold. Two sand molds pushed together form a complete internal sand cavity that receives the molten metal.

After squeezing, one of the chamber plates, a swing plate, swings open and the opposite plate, a ram plate, pushes the finished sand mold onto a conveyor. If desired, the process inserts cores into the sand cavity to form holes and recesses in the finished part. The cycle repeats until a chain of finished molds butt up to each other on the conveyor.

During this process, molten metal pours into sand cavities from a receptacle known in the art as a "pour cup" located on the top of each mold and positioned above a channel in the sand mold called the sprue. An automated device called a filter setter places the filter between the pour cup and the sprue inlet. The filter setter moves the filter into position and then injects the filter into the sand mold. The filter print is the area in the sand into which the filter inserts.

It is desirable to decrease the size of the filter print because the filter print and channels entirely fill with metal during the casting process. Metal left behind in the sprue, channels and filter print is excess metal, requiring removal from the part and repurposing.

It is a problem known in the art that repurposing metal recovered from the sprue, channels and filter print is very costly. An important component of a foundry's profitability is its ability to reduce the amount of repurposed metal and the effective "yield" of the metal that goes into the finished part. If a foundry is able to reduce the amount size of a sprue, channels and filter print by 10%, this could increase foundry yield by 2% to 5%.

There several problems associated with filters known in the art. Ceramic and silica filters must be carefully primed or they fracture and introduce fragments in the casting. Ceramic filters are large, requiring correspondingly large filter setters to hold them in place. Ceramic filters are also expensive. Custom sizes and shapes require special manufacturing, making them impractical for small production runs.

One solution is to replace ceramic filters with cloth or mesh filters. Previous attempts to use cloth filters failed because filter setters could not hold the filters in place or because the sand compromised parts used for clamping or releasing the filters. For example, sand can clog or compromise springs and ball bearings capable of securing and quickly releasing the filter. Additionally, ball bearing and spring devices known in the art did not sufficiently support the filter during insertion, resulting in incorrect filter positioning or entanglement with other parts before ejection.

It is desirable to provide a filter setter capable of holding a cloth filter.

It is further desirable to provide a filter setter with an increased resistance to compromise by sand.

SUMMARY OF THE INVENTION

In accordance with one embodiment, a filter setter apparatus includes a housing, an upper jaw, and a lower jaw. The housing includes a plurality of upper jaw attachment bores extending from a top surface of an overhang to a bottom surface of the overhang. The housing also includes a plurality of lower jaw attachment bores extending from a front side to a back side.

The upper jaw has the shape of a rectangular bar with a plurality of upper jaw overlaps depending from either side of the upper jaw. The upper jaw includes a plurality of upper attachment bores. The upper jaw has a mass causing a gravitational force acting on the upper jaw to clamp a filter inserted between the upper jaw and the lower jaw. The upper jaw is removably connected to the housing by a plurality of upper jaw shoulder bolts extending between the plurality of upper jaw attachment bores and the plurality of upper attachment bores.

The lower jaw includes a plurality of lower attachment bores. The lower jaw is removably connected to the housing by a plurality of lower jaw shoulder bolt fasteners extending between the plurality of lower jaw attachment bores and the plurality of lower attachment bores. The upper jaw partially encloses the lower jaw between the plurality of upper jaw overlaps.

In accordance with another embodiment, a filter setter system incorporates the above housing with a plurality of the above upper jaws and a plurality of the above lower jaws.

TERMS OF ART

Figure 1A:
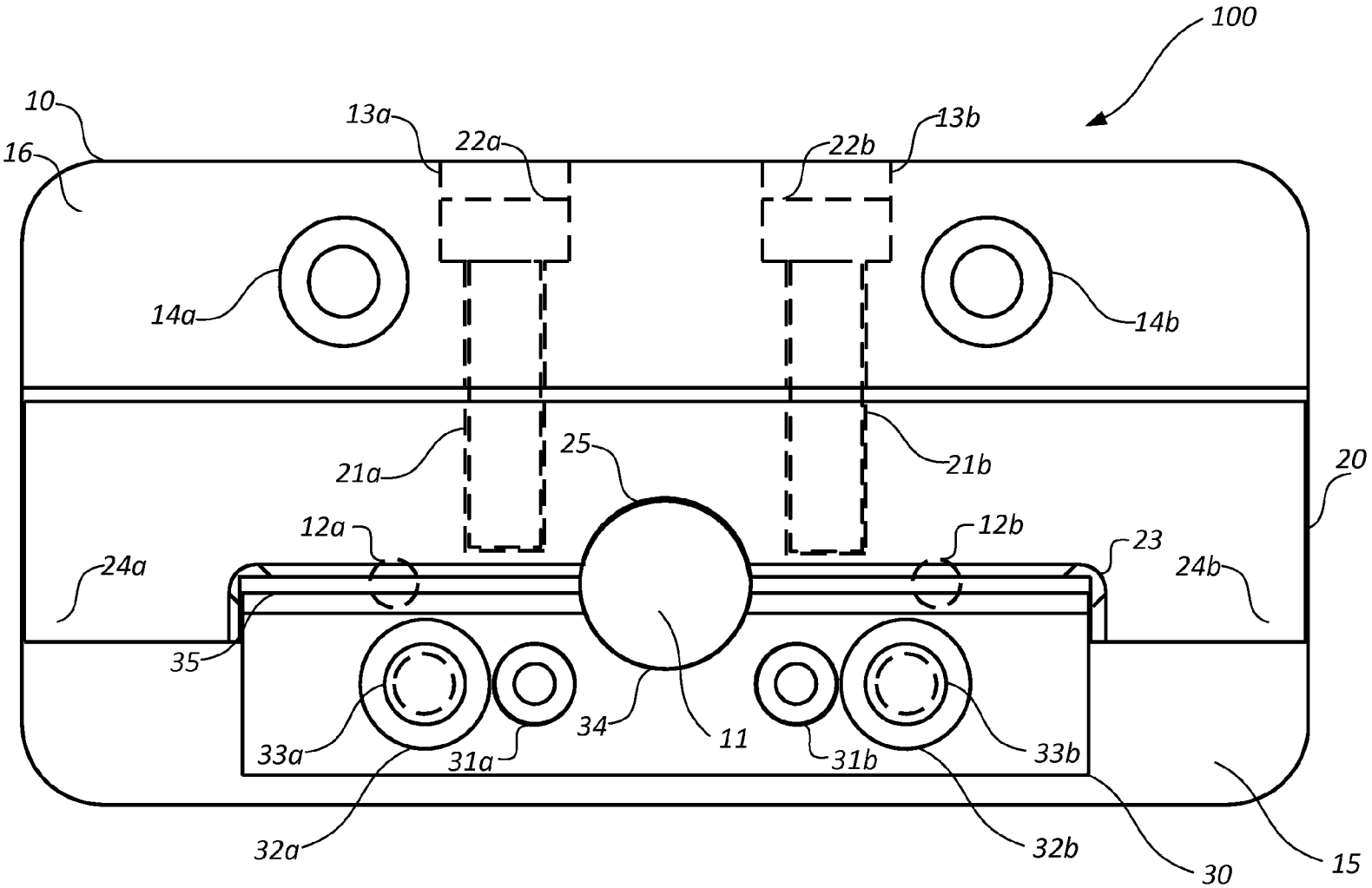
FIGS. 1*a* and 1*b* illustrate front and left side views, respectively, of an assembled filter setter.

As used herein, the term "shoulder bolt" means a bolt having an unthreaded section between bolt head and bolt thread.

DETAILED DESCRIPTION OF INVENTION

For the purpose of promoting an understanding of the present invention, references are made in the text to exemplary embodiments of a filter setter, only some of which are described herein. It should be understood that no limitations on the scope of the invention are intended by describing these exemplary embodiments. One of ordinary skill in the art will readily appreciate that alternate but functionally equivalent elements may be used. The inclusion of additional elements may be deemed readily apparent and obvious to one of ordinary skill in the art. Specific elements disclosed herein are not to be interpreted as limiting, but rather as a basis for the claims and as a representative basis for teaching one of ordinary skill in the art to employ the present invention.

It should be understood that the drawings are not necessarily to scale. Instead, emphasis has been placed upon illustrating the principles of the invention. Like reference numerals in the various drawings refer to identical or nearly identical structural elements.

Moreover, the terms "about," "substantially" or "approximately" as used herein may be applied to modify any quantitative representation that could permissibly vary without resulting in a change in the basic function to which it is related.

Figure 1B:
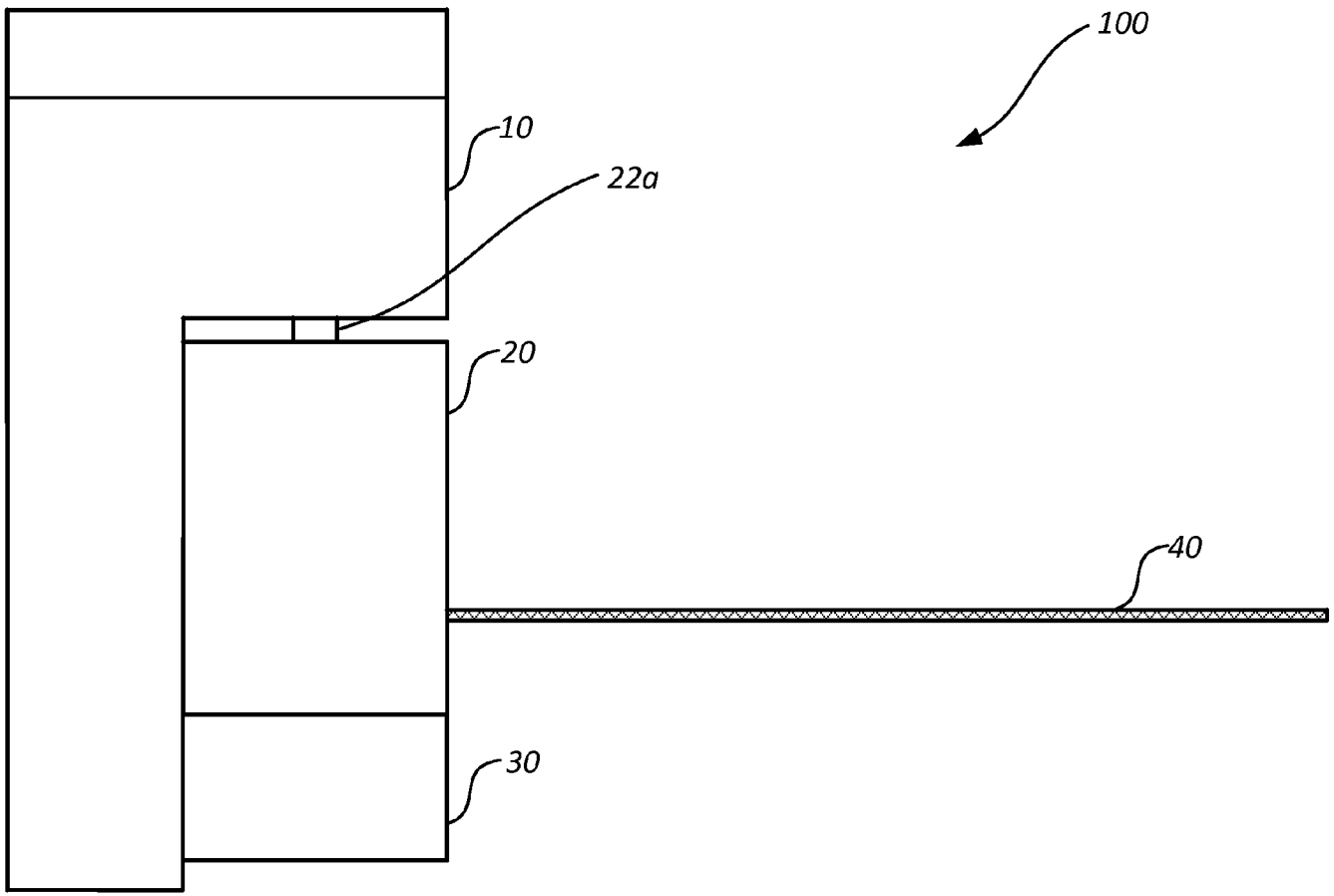

FIGS. 1*a* and 1*b* illustrate front and left side views, respectively, of an assembled filter setter 100. Filter setter 100 includes a housing 10, an upper jaw 20 and a lower jaw 30. In use, as shown in FIG. 1*b*, a cloth filter 40 lies between upper jaw 20 and lower jaw 30. Cloth filter 40 remains in position during movement of filter setter 100 due to the effect of gravity on the mass of upper jaw 20. Materials used to construct housing 10, upper jaw 20 and lower jaw 30 may include any material capable of withstanding the high temperatures of the founding process and dense enough to provide an effective mass to upper jaw 20. Such materials may include hardened steel.

Housing 10 includes ejector aperture hole 11, threaded ejector bores 12*a* and 12*b*, upper jaw attachment bores 13*a* and 13*b*, housing attachment bores 14*a* and 14*b*, front side 15 and overhang 16. Ejector aperture hole 11 allows an ejection mechanism such as a Bimba® ejection cylinder to expel cloth filter 40 from filter setter 100. Threaded ejector bores 12*a* and 12*b* permit removable attachment of such an ejection mechanism to housing 11. Housing 10 has dimensions of approximately 4 inches long, 2 inches high, and 1 inch wide at its widest point.

Upper jaw attachment bores 13*a* and 13*b* are smooth bores that run from the top of housing 10 to the bottom of overhang 16. Upper jaw attachment bores 13*a* and 13*b* allow removable attachment of upper jaw 20 to overhang 16 so that upper jaw 20 hangs parallel to front side 15. Housing attachment bores 14*a* and 14*b* permit removable attachment of housing 10 to another piece of foundry equipment using fasteners such as, but not limited to bolts, screws, locking bolts, locking screws, or any other fastening means known in the art (not shown).

Upper jaw 20 includes upper attachment bores 21*a* and 21*b*, upper jaw shoulder bolts 22*a* and 22*b*, upper leading edge 23, upper jaw overlaps 24*a* and 24*b* and upper ejector aperture bore arch 25. In the exemplary embodiment, because upper jaw 20 attaches to overhang 16, upper jaw 20 has a depth no greater than the depth of overhang 16. Furthermore, the width of upper jaw 20 is no greater than the width of housing 10.

Upper attachment bores 21*a* and 21*b* are threaded blind bores in line with upper jaw attachment bores 13*a* and 13*b*, respectively. Upper jaw shoulder bolts 22*a* and 22*b* pass through upper jaw attachment bores 13*a* and 13*b*, respectively, and into upper attachment bores 21*a* and 21*b*, again respectively, allowing variable and removable connection of housing 10 and upper jaw 20. Because upper jaw attachment bores 13*a* and 13*b* are smooth bores, upper jaw shoulder bolts 22*a* and 22*b* can slide within upper jaw attachment bores 13*a* and 13*b*, thereby permitting upper jaw 20 to raise and lower with respect to overhang 16.

Upper leading edge 23 provides easier insertion of cloth filter 40 between upper jaw 20 and lower jaw 30 by guiding cloth filter 40 between upper jaw 20 and lower jaw 30. In the exemplary embodiment, upper leading edge 23 is a chamfer having an angle of approximately 30 degrees to approximately 45 degrees. In another embodiment, upper leading edge 23 is rounded. In the exemplary embodiment, upper jaw 20 has the shape of a rectangular bar with two rectangular upper jaw overlaps 24*a* and 24*b* depending from either side. Upper jaw overlaps 24*a* and 24*b* prevent cloth filter 40 from moving from side to side when inserted between upper jaw 20 and lower jaw 30. The distance between inner walls of upper jaw overlaps 24*a* and 24*b* is the maximum width of cloth filter 40.

To accommodate wider or higher cloth filters 40, a user may remove and replace upper jaw 20 with another upper jaw 20 having a different distance between inner walls of upper jaw overlaps 24*a* and 24*b*. If using a tall cloth filter 40, the section of upper jaw 20 between upper jaw overlaps 24*a* and 24*b* may become too thin to provide sufficient mass to keep cloth filter 40 in position. In this case, increasing the height of upper jaw overlaps 24*a* and 24*b* may provide sufficient mass. Upper ejector aperture bore arch 25 is an arc corresponding to an upper circular segment of ejector aperture hole 11. Upper ejector aperture bore arch 25 provides clearance for an ejection mechanism traveling through ejector aperture hole 11.

Lower jaw 30 includes jaw locater bores 31*a* and 31*b*, lower attachment bores 32*a* and 32*b*, lower jaw shoulder bolt fasteners 33*a* and 33*b*, lower ejector aperture bore bow 34 and lower leading edge 35. In the exemplary embodiment, because upper jaw 20 attaches to front side 15 beneath overhang 16 and upper jaw 20, lower jaw 30 has a depth no greater than the depth of overhang 16 and upper jaw 20. In the exemplary embodiment, because lower jaw 30 is bounded to either side by upper jaw overlaps 24*a* and 24*b*, lower jaw 30 has a width no greater than then distance between the inner walls of upper jaw overlaps 24*a* and 24*b*.

Jaw locater bores 31*a* and 31*b* allow lower jaw 30 to receive guidance pins (not shown) attached to another piece of foundry equipment, thereby guiding placement of filter setter 100. Lower jaw shoulder bolt fasteners 33*a* and 33*b* pass through lower attachment bores 32*a* and 32*b*, respectively, and into housing 10, allowing removable connection of housing 10 and lower jaw 20. Lower jaw shoulder bolt fasteners 33*a* and 33*b* may be, but are not limited to bolts, screws, locking bolts, locking screws, or any other fastening means known in the art. Because upper jaw overlaps 24*a* and 24*b* bound lower jaw 30 to either side, replacement of upper jaw 20 generally accompanies replacement of lower jaw 30, to ensure adequately bounding and support of cloth filter 40.

Lower ejector aperture bore bow 34 is an arc corresponding to a lower circular segment of ejector aperture hole 11. Lower ejector aperture bore bow 34 provides clearance for an ejection mechanism traveling through ejector aperture hole 11. Lower leading edge 35 provides easier insertion of cloth filter 40 between upper jaw 20 and lower jaw 30 by guiding cloth filter 40 between upper jaw 20 and lower jaw 30. In the exemplary embodiment, lower leading edge 35 is a chamfer having an angle of approximately 30 degrees to approximately 45 degrees. In another embodiment, lower leading edge 35 is rounded.

Figure 2A:
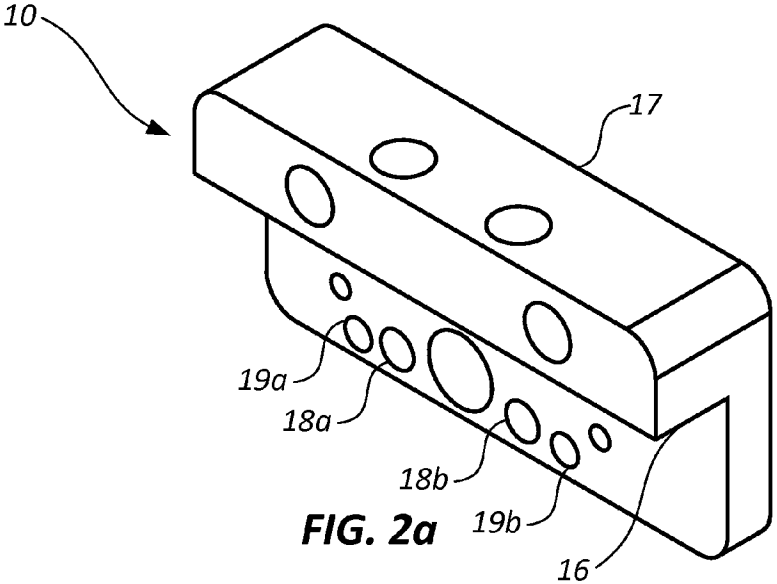
FIGS. 2*a*-2*c* illustrate perspective, front and top views, respectively, of a housing of the filter setter.
Figure 2B:
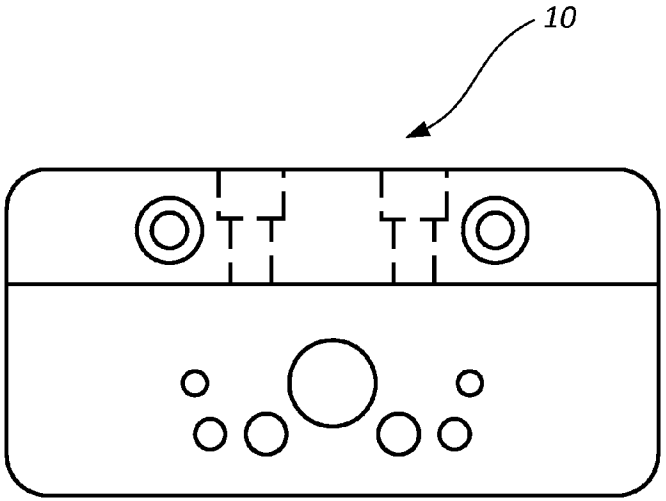
Figure 2C:
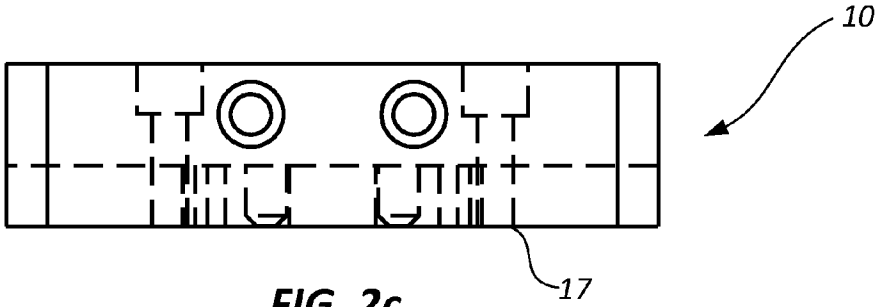

FIGS. 2*a*-2*c* illustrate perspective, front and top views, respectively, of housing 10 of filter setter 100. As can be seen in FIGS. 2*a*-2*c*, housing 10 further includes a back side 17, lower jaw locater pin bores 18*a* and 18*b* and lower jaw attachment bores 19*a* and 19*b*. Lower jaw locater pin bores

18*a* and 18*b* travel from back side 17 to front side 16, and are in line with jaw locater bores 31*a* and 31*b*, respectively. Lower jaw locater pin bores 18*a* and 18*b* allow housing 10 to receive guidance pins (not shown) attached to another piece of foundry equipment, thereby guiding placement of filter setter 100. Lower jaw attachment bores 19*a* and 19*b* are bores in line with lower attachment bores 32*a* and 32*b*, respectively. Lower jaw shoulder bolt fasteners 33*a* and 33*b* pass through lower jaw attachment bores 19*a* and 19*b*, respectively, and into lower attachment bores 32*a* and 32*b*, again respectively, allowing removable connection of housing 10 and lower jaw 30.

Figure 3A:
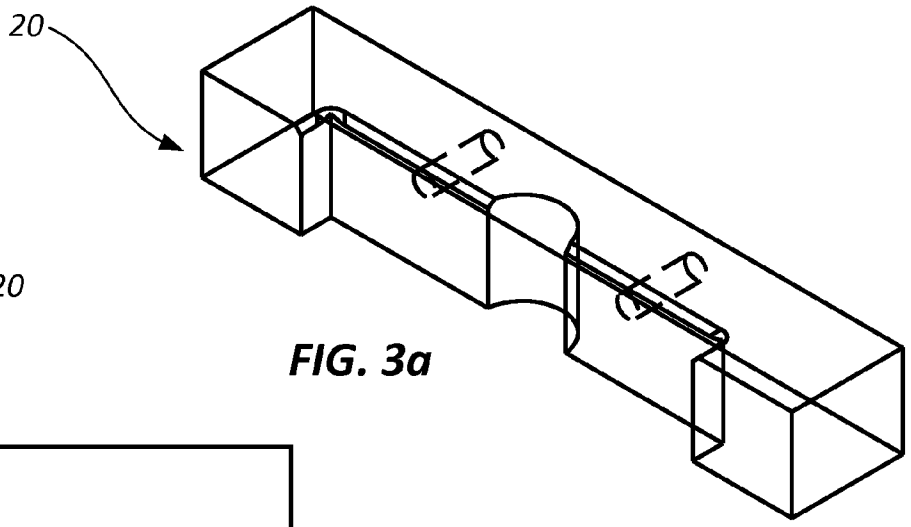
FIGS. 3*a*-3*c* illustrate perspective, front and bottom views, respectively, of an upper jaw of the filter setter.
Figure 3B:
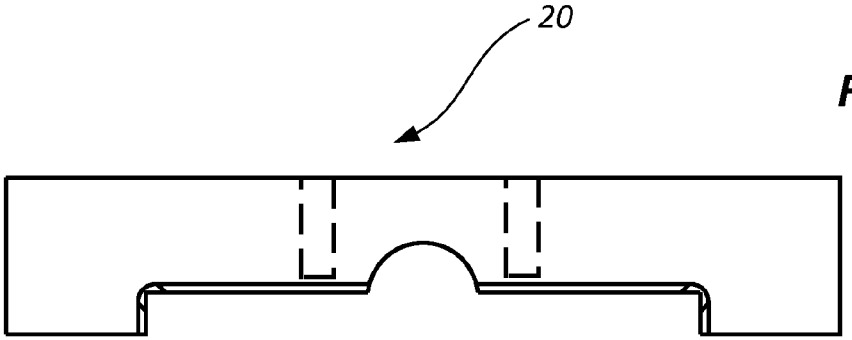
Figure 3C:
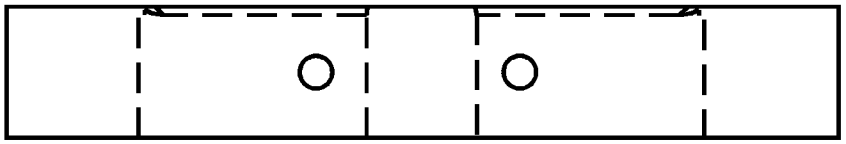

FIGS. 3*a*-3*c* illustrate perspective, front and bottom views, respectively, of upper jaw 20 of filter setter 100.

Figure 4A:
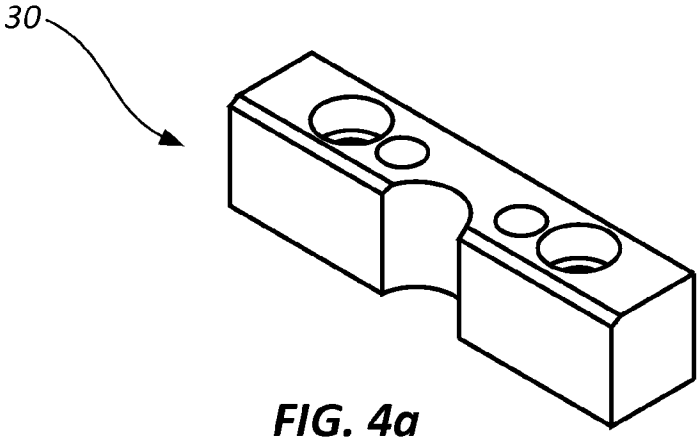
FIGS. 4*a*-4*c* illustrate perspective, front and top views, respectively, of a lower jaw of the filter setter.
Figure 4B:
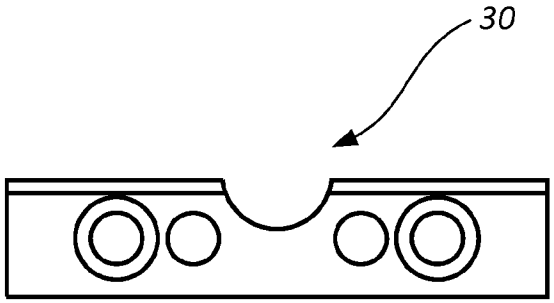
Figure 4C:
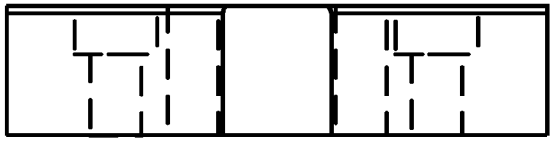

FIGS. 4*a*-4*c* illustrate perspective, front and top views, respectively, of a lower jaw 30 of filter setter 100.

In the exemplary embodiment, upper jaw 20 rests on lower jaw 30 when filter setter 100 is not in use. A space exists between overhang 16 and upper jaw 20. When a user or mechanism inserts cloth filter 40 between upper jaw 20 and lower jaw 30, upper jaw 20 rises and reduces the space between overhang 16 and upper jaw 20 until upper jaw 20 comes into contact with overhang 16. Upper jaw 20 need not contact overhang 16 to retain cloth filter 40. Gravity exerts a downward force, pushing down the mass of upper jaw 20. If filter setter 100 briefly moves into a partially rotated or upside-down orientation, inertia will prevent movement of upper jaw 20. After embedding cloth filter 40 in a mold, an ejection mechanism can eject cloth filter 40 from filter setter 100 to ensure that cloth filter 40 embedded in the mold.

In the exemplary embodiment, a user may remove one or both of upper jaw 20 and lower jaw 30, and replace them with an upper jaw 20 having different dimensions and/or a lower jaw 30 having different dimensions. For example, a user could remove lower jaw 30 and replace it with another lower jaw 30 having a different height, allowing filter setter 100 to accommodate a higher cloth filter 40. A user could remove upper jaw 20 and lower jaw 30, and replace them with a wider lower jaw 30 and a correspondingly dimensioned upper jaw 20. This new configuration would allow use of a wider cloth filter 40. Various combinations of upper jaw 20 and lower jaw 30 can accommodate a wide variety of cloth filters 40 using the same housing 10 as a base.

What is claimed is:

1. A filter setter apparatus, comprised of:

a housing, wherein said housing comprises a plurality of upper jaw attachment bores extending from a top surface of an overhang to a bottom surface of said overhang and a plurality of lower jaw attachment bores extending from a front side to a back side;

an upper jaw having the shape of a rectangular bar, wherein said upper jaw comprises a plurality of upper attachment bores and a plurality of upper jaw overlaps depending from either side of said upper jaw; and a lower jaw, wherein said lower jaw comprises a plurality of lower attachment bores, wherein said upper jaw has a mass causing a gravitational force acting on said upper jaw to clamp a filter inserted between said upper jaw and said lower jaw, wherein said upper jaw is removably connected to said housing by a plurality of upper jaw shoulder bolts extending between said plurality of upper jaw attachment bores and said plurality of upper attachment bores, wherein said lower jaw is removably connected to said housing by a plurality of lower jaw shoulder bolt fasteners extending between said plurality of lower jaw attachment bores and said plurality of lower attachment bores, wherein said upper jaw partially encloses said lower jaw between said plurality of upper jaw overlaps.

2. The apparatus of claim 1, wherein a width of said upper jaw is less than or equal to a width of said housing.

3. The apparatus of claim 1, wherein a depth of said upper jaw is less than or equal to a depth of said overhang.

4. The apparatus of claim 1, wherein a depth of said lower jaw is less than or equal to a depth of said upper jaw.

5. The apparatus of claim 1, wherein a width of said lower jaw is less than or equal to a distance between said plurality of upper jaw overlaps.

6. The apparatus of claim 1, wherein said housing further comprises an ejector aperture hole extending from said front side to said back side.

7. The apparatus of claim 6, wherein said upper jaw further comprises an upper ejector aperture bore arch corresponding to an upper circular segment of said ejector aperture hole.

8. The apparatus of claim 6, wherein said lower jaw further comprises a lower ejector aperture bore bow corresponding to a lower circular segment of said ejector aperture hole.

9. The apparatus of claim 1, further comprising an ejection mechanism coupled to said housing through a plurality of ejector bores.

10. The apparatus of claim 1, wherein said housing further comprises a plurality of housing attachment bores.

11. The apparatus of claim 1, wherein said housing further comprises a plurality of lower jaw locater pin bores, wherein said lower jaw further comprises a plurality of jaw locater bores, wherein said each of said plurality of lower jaw locater pin bores shares a common axis with one of said plurality of jaw locater bores.

12. The apparatus of claim 1, further comprising an upper leading edge between front and bottom surfaces of said upper jaw and a lower leading edge between front and upper surfaces of said lower jaw.

13. The apparatus of claim 12, wherein said upper leading edge forms a chamfer angle of approximately 30 degrees to approximately 45 degrees.

14. The apparatus of claim 12, wherein said lower leading edge forms a chamfer angle of approximately 30 degrees to approximately 40 degrees.

15. The apparatus of claim 1, wherein the dimensions of said housing are approximately 4 inches long, 2 inches high, and 1 inch wide at said housing's widest point.

16. A filter setter system, comprised of:

a housing, wherein said housing comprises a plurality of upper jaw attachment bores extending from a top surface of an overhang to a bottom surface of said overhang and a plurality of lower jaw attachment bores extending from a front side to a back side;

a plurality of upper jaws having the shapes of rectangular bars, wherein each of said plurality of upper jaws comprises a plurality of upper attachment bores and a plurality of upper jaw overlaps depending from either side of said upper jaw; and a plurality of lower jaws, wherein each of said plurality of lower jaws comprises a plurality of lower attachment bores, wherein each of said plurality of upper jaws has a mass causing a gravitational force acting on said upper jaw to clamp a filter inserted between said upper jaw and one of said plurality of lower jaws, wherein each of said plurality of upper jaws is removably connected to said housing by a plurality of upper jaw shoulder bolts extending between said plurality of upper jaw attachment bores and said plurality of upper attachment bores, wherein each of said plurality of lower jaws is removably connected to said housing by a plurality of lower jaw shoulder bolt fasteners extending between said plurality of lower jaw attachment bores and said plurality of lower attachment bores, wherein each of said plurality of upper jaws partially encloses at least one of said plurality of lower jaws between said plurality of upper jaw overlaps.

17. The system of claim 16, wherein at least one of said plurality of upper jaws has different dimensions from another of said plurality of upper jaws.

18. The system of claim 16, wherein at least one of said plurality of lower jaws has different dimensions from another of said plurality of lower jaws.

19. The system of claim 16, wherein each of said plurality of upper jaws has the same mass.

20. The system of claim 16, wherein at least one of said plurality of upper jaws has a different mass from another of said plurality of upper jaws.

* * * * *